United States Patent [19]

Souch

[11] Patent Number: 4,691,481

[45] Date of Patent: Sep. 8, 1987

[54] DOPSTICK TRANSFER JIG DEVICE AND METHOD FOR USING SAME

[76] Inventor: Julius Souch, 1642 E. 33rd St., Lorain, Ohio 44055

[21] Appl. No.: 863,365

[22] Filed: May 15, 1986

[51] Int. Cl.[4] ..... B23Q 7/00

[52] U.S. Cl. ..... 51/277; 29/559

[58] Field of Search ..... 51/277, 229, 281 R; 29/559

[56] References Cited

U.S. PATENT DOCUMENTS 2,724,220 11/1955 Shaw ..... 51/229

3,098,327 7/1963 Malin ..... 51/229

*Primary Examiner*—Roscoe V. Parker

*Attorney, Agent, or Firm*—Oldham, Oldham & Weber Co.

[57] ABSTRACT

A jig for transferring a partially faceted gemstone from a first dopstick to a second dopstick, without altering the spatial relativity to the faceting device so that the unfinished gemstone can be faceted. The jig comprises two grooved blocks, and associated clamps. One block is located at each end of a base portion, with a swivelable pawl mounted in a slot at each end of the base portion. A first dopstick with a partially faceted gemstone cemented to one end, and a calibrated, notched indexing gear fastened to the other end, is removed from the faceting device, placed in one of the blocks, with the gear end adjacent to a pawl. The pawl is swiveled into contact with the gear; the dopstick is rotated until the pawl engages a gear knotch; the engaged knotch is noted, and the dopstick is secured to the block with its associated clamp. A second dopstick is placed in the other block, moved into contact with the gemstone, cemented thereto, and firmly secured with its associated clamp. The gear is thereafter transferred from the first to second dopstick where it is loosely fastened and rotated until its adjacent pawl can be swiveled into the knotch previously engaged by the first pawl. The gear is fastened on the dopstick, and the cemented connection between the gemstone and the first dopstick is severed. The second dopstick with attached gemstone is thereafter removed from the transfer jig, oriented in the faceting device, and faceting completed.

4 Claims, 8 Drawing Figures

DOPSTICK TRANSFER JIG DEVICE AND METHOD FOR USING SAME

TECHNICAL FIELD

This invention relates to the faceting of gemstones. More particularly, this invention relates to a device for transferring gemstones in a specific orientation so that they can be cut and polished in mechanical faceting machine assemblies. Specifically, this invention is directed to the accurate transfer of a partially faceted gemstone from one holding device to another such device, so that the unfinished portion of the stone can thereafter be accurately faceted.

In their natural state, gemstones are generally unsuitable for ornamental uses, since they are commonly of an inappropriate size, shape, or both. In addition, proper cutting or faceting, which, among other things is dictated by the natural index of refraction of the stone, greatly enhances the brilliance and attractiveness of such gemstones.

In the past, and even now, the cutting of gemstones is frequently performed much in the nature of an art, requiring considerable knowledge, a fairly lengthy apprenticeship, and a high degree of skill. Practised in this way, the occupation demands a high order of manual dexterity, a practiced eye, and experienced judgment.

While many practitioners of the art have mastered and possess these attributes, many do not, and there have been numerous attempts to reduce the number and levels of skills needed to successfully practice the profession. In addition, it has been recognized that when the faceting process is made more mechanical, it improves the consistency and the quality of results, and also reduces the amount of time required for the faceting operation. Furthermore, as in so many other fields, gemstone cutting has increasingly become an area of interest to hobbyists and do-it-yourselfers.

Responding to this preceived need, there have in the past been, and there continue to be many attempts to devise machinery to make more mechanical, or to semiautomate the process of gemstone faceting. For example, there have been developed a myriad of mechanical faceting devices which to a greater or lesser extent, make gemstone facet cutting largely a matter of setting dials, adjusting positioning devices, and other processes demanding a reduced order of skill.

Typical of devices of this type is one in which an elongated, pencil shaped cylinder or "dop", also known as a "dopstick", on whose end the rough gemstone is mounted, is placed in an indexing, or faceting head of the mechanical faceting device. The head is used to mechanically position the stone for cutting and polishing the facets on an abrasive surface known as a "lap". When one end of the gemstone has thus been completed, the finished end of the gemstone is attached to a second dop, and the gemstone's connection with the first dop is severed, leaving the unfinished end free for presentation to the lap. It is imperative, however, that the positional relativity of the gemstone to the dops, as the latter are mounted in the indexing head, be preserved during the transfer process.

To understand the importance of the transfer process, it is necessary to understand the structure of a cut gemstone. A finished gemstone consists of an upper and a lower half, the crown and the pavilion, respectively, the two halves meeting at a juncture, termed the girdle. Facets cut in the crown meet opposite facets cut in the pavilion at the girdle, and it is necessary that the lower end, or base of facets in the crown be coextensively aligned with the upper end, or topside of facets in the pavilion at their juncture point at the girdle. This assures a pleasing symmetry of the gemstone, and allows the brilliance of the gemstone to be unimpeded.

If the positional relativity of the gemstone and the original dop on which one end of the gemstone has been cut is not the same as the relativity of the gemstone to the dop on which the other end is to be cut, as the dops are mounted in the indexing head, the circumferential angles at which opposite ends of the gemstone are sequentially presented to the lap will differ, and consequently the upper and lower facets will be displaced with respect to each other at the girdle. Consequently, they will not be coextensively aligned, and the gemstone's appearance will be marred.

BACKGROUND ART

In the past, transfer dopping, as the transfer process is called, has been accomplished in a number of ways.

One such way simply involves adhesively cementing or mounting the gemstone on the dop with wax. Heated wax is placed on the end of the dop, the gemstone is contacted with the waxed dop while the wax is still hot, and the gemstone is securely adhered thereto when the wax cools. The dop is subsequently placed in the indexing head and the desired facets cut on the free end of the gemstone. The dop is thereafter removed from the indexing head, and the finished end of the gemstone is secured to a second dop. The latter dop is remounted loosely in the indexing head, brought into contact with the lap and visually rotatably adjusted until a base of one of the previously cut facets is substantially parallel to the surface of the lap. Thus oriented, the dop is then secured, and the cutting of the unfinished end of the gemstone undertaken.

While visual positioning is simple, it has the inherent drawback of depending on the cutter's visual acuity and skill, and it oftentimes produces stones with facets slightly misaligned at the girdle, with the undesirable consequences previously described.

Another way which has been suggested is that described in U.S. Pat. No. 2,724,220, wherein the dopsticks employed have a small locating pin projecting at right angles from the dops. When one end of a gemstone mounted on a dop has been faceted, it is placed in a bracket with the pin in contact with a bracket surface. A second dop whose projecting pin is also in contact with the common surface is then brought into contact with the free end of the gemstone; the second dop is attached thereto, and the connection of the gemstone with the first dop is severed. The transferred gemstone thus maintains its relativity with respect to the pin of the dop on which it is mounted at any given point in the process. The pin also serves to engage the indexing head, determining the orientation of the gemstone to the head, and therefore to the lap.

While the method has distinct advantages over the visual system described, it does have a number of deficiencies. Its usefulness is for instance, limited to a specific mechanical faceting device, that is, one adapted to receive a dop positioning pin of the type described. While the mechanical faceting device taught in the Patent obviously is so adapted, it requires different holders to receive the special dop in order to cut particular ones of the different facet arrangements possible. A "brilliant" cut, for example, necessitates a different dop holder than in an instance where a different shaped gemstone, or one with different facet spacing is desired. Furthermore, as will be appreciated, specialized dops are required, which are not commonly available.

Now, however, a method has been found which permits transfer dopping to be accomplished involving the transfer of a gemstone from one dop stick to another, while maintaining precise alignment of the gemstone relative to the dop in its mounted position in the indexing head of a mechanical faceting device.

The method of the invention is easily and quickly accomplished, even by unskilled cutters, and it uses dopsticks commonly employed in faceting gemstones by any of a number of methods.

Dop transfer, as carried out by the invention herein described, is useful in a variety of mechanical faceting devices, rather than being restricted to a specific mechanical faceting device.

By means of the invention, the transfer is accomplished through use of a dop transfer device or "jig" of a simple design that lends itself to retrofitting many existing transfer devices.

DISCLOSURE OF THE INVENTION

In accordance with this invention, a dop transfer process and device has been discovered which involves a dop transfer jig consisting of a base, with blocks having a longitudinal groove located at each end thereof. Each of the blocks is fitted with a clamp in order to allow a dopstick to be securely held in the groove therein. Each of the blocks is also fitted with an end slot in which a knife edge. or pawl is swivelably mounted.

In the transfer process, a dopstick with a semifacted gemstone mounted on one end, and the other end of which has been inserted through a calibrated indexing gear, is placed in the groove of a first of the blocks. The pawl of the first block is then swiveled upward and the dop rotated until the pawl engages one of the calibrated knotches of the indexing gear. The knotch so engaged is observed, after which the dop is securely clamped.

A second dopstick is located in the groove of the second of the blocks in a position in which one end of the dop contacts the free, or finished end of the semifaceted gemstone attached to the first dopstick. The second dop is thereupon also attached to the gemstone, for example, by means of heated wax, and securely clamped.

The indexing gear is then removed from the first dop and loosely inserted on the free end of the second dop. The pawl in the second block is swiveled upward, and the indexing gear rotated on the dop until the pawl engages the same knotch previously engaged by the pawl in the first block. The indexing gear is then tightly secured to the second dop, assuring the same relative alignment between the indexing gear, dop, and gemstone, as in the case of the first dop.

The attachment between the gemstone and the first dop is thereupon severed. The second dop is unclamped from its block, inserted and oriented in the indexing head, and the faceting operation is continued on the unfinished end of the gemstone.

BRIEF DESCRIPTION OF THE DRAWING

The invention will be more clearly understood by reference to the attached drawings, which are intended as examples and not as limitations, in which.

BEST MODE FOR CARRYING OUT THE INVENTION

Figure 1:
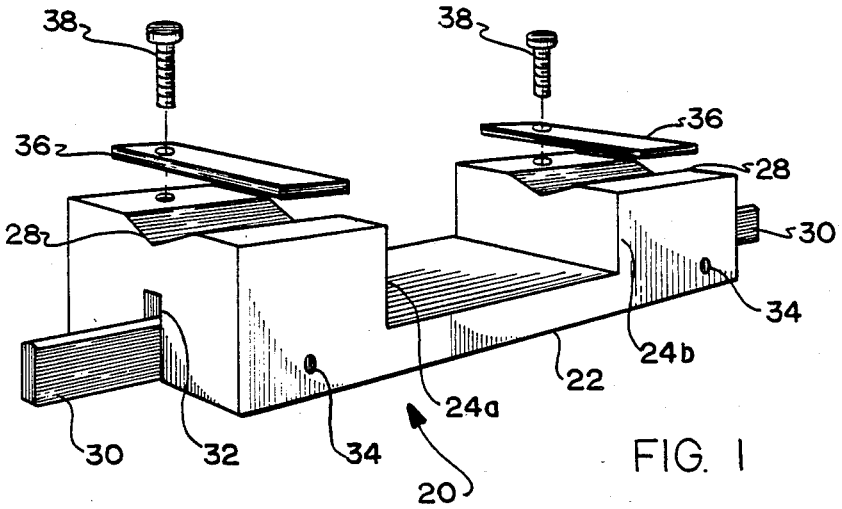
FIG. 1 is a perspective view of the transfer jig device of the invention.

Referring now to the figures, FIG. 1 shows the dop transfer jig 20 of the invention comprising base 22 with blocks 24(*a*) and 24(*b*), which together form an integral unit in which pawls 30 are swivably located in slots 32, on pivot pins 34. Each of the blocks 24(*a*) and 24(*b*) has a groove 28 located therein for the purpose of accomodating a dopstick during the transfer process. Clamps 36 are stiff pieces of material, usually metal, provided for each of the blocks 24(*a*) and 24(*b*) and secured to the blocks, for example, by means of threaded fasteners 38 so as to hold the dopsticks securely in place, as required, during the transfer process.

The material of construction employed in fabricating the transfer jig 20 is not of critical importance, and it may be made from wood, plastic or metal, as desired. Metal has been found to be desirable for the jig and its component parts, however, because of its wearing qualities and stabilizing weight.

Dimensions of the transfer jig 20 will depend on such consideration as the length of the dopsticks to be used, their diameter, the diameter of the indexing gear and so on. The location of the slots 32 is important, however, since the location of each of them relative to the adjacent groove 28 in the block in which they are located must be identical. In this regard, it has been found advantageous to locate the slots immediately below, and in line with the bottoms of grooves 28.

Figure 2:
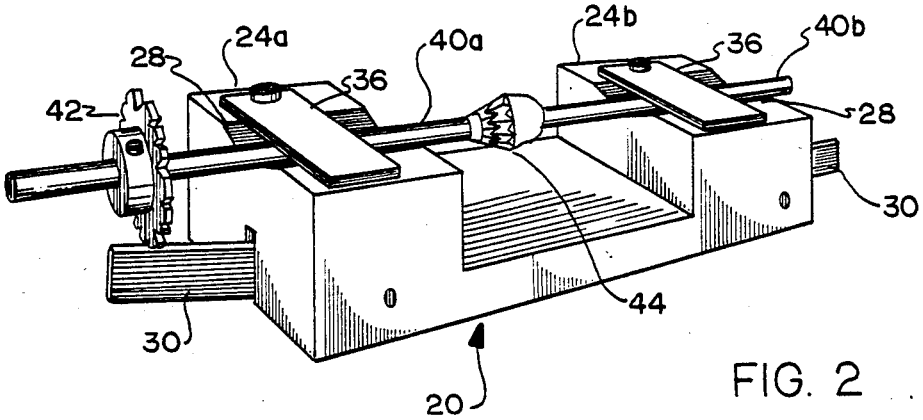
FIG. 2 is a perspective view of the transfer jig device of the invention in the process of being used to transfer a gemstone from one dop to another.

FIG. 2 is also a perspective view of the transfer jig 20, in which, however, there is shown dopsticks 40(*a*) and 40(*b*) mounted in groove 28. The dopsticks are held securely in place by clamps 36 attached to blocks 24(*a*) and 24(*b*). The view shows a semifinished gemstone 44 in the process of being transferred from one dop to the other, an operation involving attachment of indexing gear 42 sequentially to each of the dops 40(*a*) and 40(*b*).

By way of further and more detailed explanation of the faceting process, particularly as it relates to the transfer process and to FIG. 2, initially the gemstone is attached to the end of a dopstick with some form of cement, wax commonly being used. An indexing gear such as 42 is attached to the dop, the dop is inserted in the indexing head of the mechanical faceting device, and the free end of the gemstone at the end of the dop is faceted. The dop, including its associated, fastened indexing gear 42 is thereafter removed from the indexing head and loosely placed in one of the grooved blocks of the transfer jig. An adjacent first pawl 30 is then swiveled upward until it contacts the indexing gear 42, and the latter is rotated until the pawl and one of the knotches in the indexing gear coincide. At that point, the clamp 36 holding the dop in place is securely fastened, and the reading on the calibrated indexing gear 42 at the point it is engagably contacted by the first pawl 30 is noted.

A second dop is then inserted in the other grooved block of the jig, and moved into contact with the gemstone 44 mounted on the free end of the first described dop. The clamp holding the second dopstick is tightened, and the contacting end is cemented to the gemstone. Following this, the indexing gear 42 is transferred from the first dop to the second dop, and loosely mounted thereupon. A second pawl 30 is subsequently brought into contact with the indexing gear 42, and the latter is rotated until the gear knotch previously noted is engagably contacted. The indexing gear 42 is then firmly fastened, and the cemented connection between the gemstone and the first dop is severed. The second dop is thereafter removed from the transfer jig, the cement adhering to the free end of the attached gemstone is removed, and the second dop inserted into the indexing head for completion of the faceting process.

FIG. 2 shows the transfer process near its completion, at the point where indexing gear 42 has been transferred to the second dop 40(*a*) and engagably contacted with a pawl 30.

Figure 3:
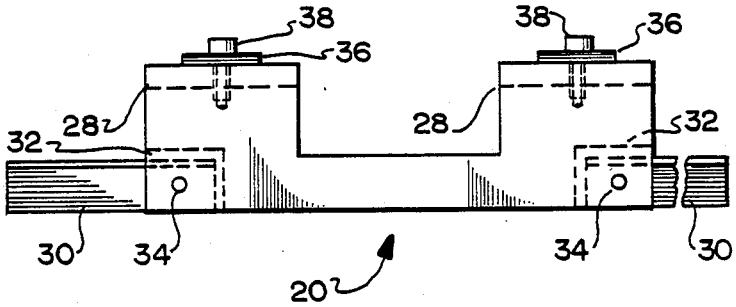
FIG. 3 is an isometric side elevation of the transfer jig device of the invention.

FIG. 3 is an isometric side view of the dop transfer jig 20 showing details of the pawls 30, mounted in slots 32, on pivot pins 34. Also shown are the grooves 28, the clamps 36, and the clamp fasteners 38. As mentioned, the exact dimension of features such as the slots 32 and pawls 30 are capable of considerable latitude, it merely being necessary that the pawls be capable of pivoting upward to engage the indexing gear 42. Likewise, the configuration, depth, etc. of grooves 28, and their associated clamps 38 may be varied considerably, so long as the assembly is capable of securely holding the dops 40 in the transfer process.

Figure 4:
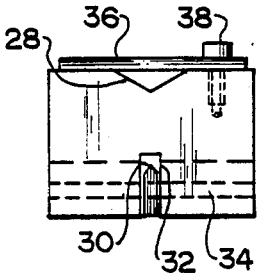
FIG. 4 is an end view of the transfer jig device of FIG. 3.

FIG. 4 is an isometric end view of the transfer jig of FIG. 3 showing further details of the transfer jig 20, including slot 32, pawl 30, and pawl pivot pin 34. Also shown is a further view of clamp 36, clamp fastener 38, and the associated dop groove 28.

Figure 5:
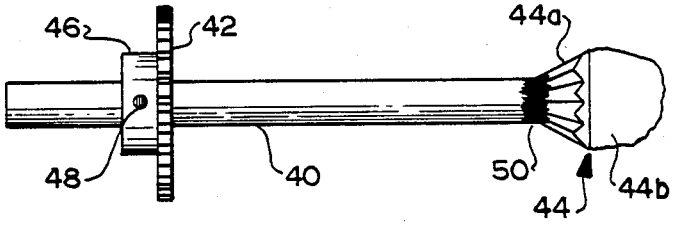
FIG. 5 is a side view of a dopstick with an indexing gear and partially faceted gemstone attached.

FIG. 5 shows details of a dop stick 40 with a mounted gemstone 44 consisting of a finished end 44(*a*), and a rough, or unfinished end 44(*b*). The gemstone is mounted to the dop 40 with wax 50, which acts as a cement. At the end of the dop opposite the gemstone is mounted an indexing gear 42, held on the dop by means of gear collar 46, which is secured by a set screw 48. The dop may be made from a variety of materials, wood or metal being common, and its length and diameter may be varied, depending on the indexing head with which it is to be used, as well as the size of the gemstones to be faceted. Different sections along the length of the dop may also have different diameters if desired.

Figure 6:
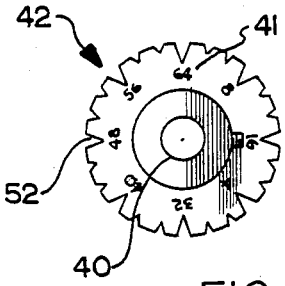
FIG. 6 is an end view of a dopstick and attached indexing gear.

FIG. 6 illustrates one type of indexing gear 42 which may be employed in the invention. The Figure shows the knotches 52 of the gear, its calibrations 41, and an end view of the dopstick 40 on which it is mounted. The knotches of the gear correspond to positions of the various facets which can be cut on the gemstone.

Figure 7:
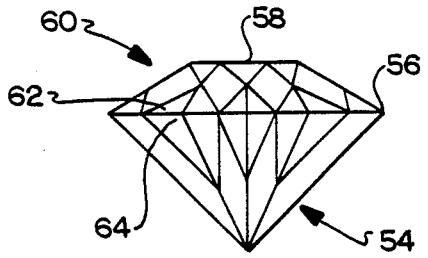
FIG. 7 is a gemstone faceted in the "brilliant" style.

FIG. 7 is an elevation of one type of gemstone whose faceting is contemplated by the invention. The particular cut shown is called a "brilliant", which comprises in the Figure a crown portion 60, a pavilion portion 54, a girdle 56, and a table 58. The Figure is useful among other things to indicate the importance of having the lower end or base of the facets 62 in the crown coextensively aligned with the upper end or topside of facets 64 in the pavillon, at their juncture point in the girdle, to preserve the symmetry of the finished gemstone.

Figure 8:
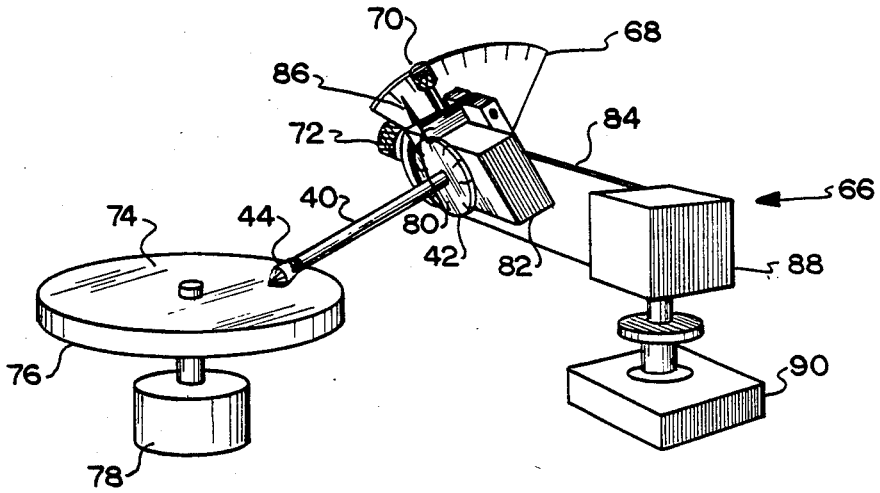
FIG. 8 is a perspective view of a mechanical faceting device, and its associated lap wheel.

FIG. 8 shows one type of a mechanical faceting device 66 in which a dopstick 40 with an associated indexing gear 42 has been mounted. Facet orienting pawl 80 positionally locates the dop 40, and therefore, gemstone 44, so that the facet surface correctly contacts the abrasive surface 74 of lap 76, which latter is circularly driven by electric motor 78. The angle at which the facet is to be cut with respect to the plane of the girdle is determined by angle at which the indexing head 82 is attached to the pivot arm 84, indicated by pointer 86 on protractor dial 68. Once determined, the angle is securely fixed by tightening locking head clamp knob 72. Pivot block 88 on mounting base 90 allows the pivot arm 84, and therefore gemstone 44, to be swept from side to side on abrasive surface 74 in the cutting or faceting process.

To obtain the number of facets desired, facet orienting pawl 80 is engaged in an initial cutting knotch on indexing gear 42 by suitably adjusting pawl clamp screw 70, and the facet is cut. The pawl 80 is then disengaged, the indexing gear 42 rotated to the next facet knotch selected, and the process is repeated until all the required facets have been finished. When one end of the gemstone has been completely cut, the dopstick is removed from indexing head 82, and the dopstick is placed in the dopstick transfer jig for the transfer process previously described. The new dopstick is then reinserted in the indexing head, oriented, and the cutting of the gemstone is completed.

The mechanical faceting device illustrated is of course merely one example of the type of devices to which the transfer jig device of the invention has application.

While a specific embodiment of an improved dopstick transfer jig has been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. A jig device for transferring a partially faceted gemstone from one dopstick to another dopstick so as to permit spatial relativity of the gemstone surfaces to the indexing head of the mechanical faceting device, and therefore to the facet cutting surface, to be maintained comprising:

two grooved blocks in association with each other;

means for clamping a dopstick in each of said grooves, and two swivelable pawls, wherein said grooved blocks are attached to a base piece and separated from each other by a space large enough to accommodate the gemstones to be faceted; and wherein the groove in each of said blocks is in horizontal and vertical alignment with the groove in the other, and wherein further, said pawls are mounted in slots substantially directly below and parallel to said grooves, and are held by, and swivelable on pins located in said blocks, one end of each of said pawls being adapted to swivel upward toward an imaginary line extending in line with said grooves, and away from said jig device.

2. A jig device according to claim 1 in which said clamping means consists of a piece of metal positioned over each of said grooves, said piece being adapted to be held securely to the jig device by a fastening means.

3. A jig device according to claim 1, the components of which are metal, and said grooves are vee shaped.

4. A method of transferring a partially faceted gemstone mounted on the end of a first dopstick, with a notched indexing gear also mounted on said first dopstick, to a second dopstick comprising:

(a) removing said first dopstick from the indexing head of the mechanical faceting device on which the gemstone was partially faceted and loosely placing said first dopstick in the groove of a first block of a jig device;

(b) swiveling the pawl of said first block upward into contact with said indexing gear and rotating said first dopstick until said pawl engages one of the indexing gear notches.

(c) securing said first dopstick in said groove with said clamping means;

(d) placing a second dopstick in the groove of a second block of said jig device so that one of its ends contacts the free end of the partially faceted gemstone in the space between the blocks, and securing said second dopstick in said groove with said clamping means;

(e) cementing the gemstone contacting end of said second dopstick to the partially faceted gemstone.

(f) removing said indexing gear from said first dopstick and placing it loosely on the free end of said second dopstick;

(g) swiveling the pawl of said second block upward into contact with the indexing gear, and rotating said indexing gear until said pawl engages the indexing gear knotch formerly engaged by the previous pawl;

(h) securing said indexing gear firmly to said second dopstick;

(i) severing the connection of said first dopstick from said partially faceted gemstone; and (j) removing said second dopstick from the transfer jig, cleaning the cement from the severed end of the gemstone, and reinserting said second dopstick in said indexing head of the mechanical faceting device, whereby the unfaceted end of the gemstone is ready for faceting in spatial relativity to the indexing head of the mechanical faceting device, and therefore to the facet cutting surface, identical to the previous such relativity of said first dopstick.

* * * * *